United States Patent [19]

Seragnoli

[11] 3,982,380

[45] Sept. 28, 1976

[54] DEVICE FOR SEALING THERMOPLASTIC OVERWRAPS

[75] Inventor: Enzo Seragnoli, Bologna, Italy

[73] Assignee: G. D. Societa per Azioni, Italy

[22] Filed: June 24, 1975

[21] Appl. No.: 589,896

[30] Foreign Application Priority Data

July 10, 1974 Italy ..... 3439/14

[52] U.S. Cl. ..... 53/77; 53/379; 156/359; 156/583

[51] Int. Cl.[2] ..... B65B 51/14

[58] Field of Search ..... 53/379, 373, 203, 229, 53/329, 77, 375; 156/359, 583, 358, 306

[56] References Cited

UNITED STATES PATENTS

| | | | |
|---|---|---|---|
| 3,431,398 | 3/1969 | Wahle | 53/379 X |
| 3,692,611 | 9/1972 | Kühnle | 156/358 |

*Primary Examiner*—Othell M. Simpson
*Assistant Examiner*—Horace M. Culver
*Attorney, Agent, or Firm*—Robert E. Burns; Emmanuel J. Lobato; Bruce L. Adams

[57] ABSTRACT

A device for controlling the sealing of thermoplastic wraps comprises contrivances for heat-sealing each wrap, at a speed compatible with individual speed levels of a wrapping machine; cams for causing the heat-sealing contrivances to operate with a reciprocating motion; means sensitive to variations in the speed levels of the machine and which trip the cam linkage so that the sealing action of the heat-sealing contrivances is suitably put into and out of operation; and a heat-sensor so-connected to the heat-sealing contrivances that, following the switching in of the heat-sealing contrivances, follow-up means respond to the reciprocating motion of the cams through differentiated operating time multiple tracks, in such a way as to operate the heat-sealing contrivances in a differentiated operating time to suit the temperature detected in them by the heat-sensor.

3 Claims, 3 Drawing Figures

DEVICE FOR SEALING THERMOPLASTIC OVERWRAPS

BACKGROUND OF THE INVENTION

This invention relates to wrapping machines and, in particular to the type of machines known as overwrapping machines employed to overwrap, for example, packets of cigarettes or similar prismatic products, in transparent thermoplastic material. The invention provides an improved system with which to control the sealing of wraps effected with such material.

DESCRIPTION OF THE PRIOR ART

The sealing of wraps made of thermoplastic material, as is known, requires very narrow temperature limits to be observed. Means for controlling these temperatures have been in use for some time now, in different forms and with various operating principles.

In particular, on overwrapping machines for the above mentioned use, where packets of cigarettes follow one another in succession along a wrapping line, at different operating speed levels, in a plurality of stations in which sealing contrivances operate, it is known, as variations occurs in the operating speed of the overwrapping machine and thus also in the contact time between the thermoplastic material wrap and the sealing members, to vary the source of heat to the sealing members. For this purpose, such members have been designed in such a way as to incorporate a plurality of electrical resistors, sized to suit the various operating speeds of the machine, so as to allow them to be switched as changes occur in the operating speed of the machine.

Again with overwrapping machines of the above mentioned type, on which the sealing contrivances are connected to means that cause them to operate with a reciprocating motion, it is known, as changes occur in the operating speed of the machine, to maintain constant both the heat source and the time the thermoplastic material wrap is in contact with the sealing contrivances.

This latter type of device is, in practice, realized by having, for example, a device for controlling the movement of the sealing contrivances connected to the mechanism provided for changing over the operating speed of the machine and able to lengthen or shorten its action on the sealing contrivances. This has been done through a single operating cam, working in conjunction with a device for controlling the differentiated operating time of the single cam and connected to a device sensitive to variations in the speed of the machine. It is also known to provide a machine of the above mentioned type, comprising, along the wrapping line, a plurality of sealing stations, and means whereby the total contact time (the sum of the individual contact times) is suitably controlled for perfect sealing, by cutting off one or more of the sealing contrivances, so that the total contact time can be maintained constant for all speed levels of the machine.

In this latter instance, what happens in actual practice is that when one or more of the sealing contrivances are put out of operation following a variation in the operating speed of the machine, the non-operative sealing contrivances undergo a notable increase in temperature due to thermal inertia, on account of heat not being withdrawn from them because of their not being placed in contact with material to be sealed.

When they are switched back in again, after a corresponding variation has been made to the operating speed level of the overwrapping machine, they cause the thermoplastic wrapping material to be scorched or even burnt, thereby bringing about a recurrence of the very difficulties it was wished to avoid.

SUMMARY OF THE INVENTION

The basic object of the present invention is, therefore, to overcome the aformentioned problem resulting from the overheating, due to thermal inertia, of the sealing contrivance selectively taken out of the operating cycle. Another object is to provide a device for the use mentioned above, improved in such a way that the sealing contrivances ae put back into service in proper condition, once the corresponding speed level of the machine has been restored.

This and other objects have been attained with the device according to the invention. The device serves to control machines that overwrap, for example, packets of cigarettes in succession along a wrapping line, at various operating speeds, in a plurality of sealing stations. Sealing contrivances are provided with heating means with which to seal the wraps at a speed compatible with the individual operating levels. The sealing contrivances are connected to cams that cause them to operate with a reciprocating motion. They are connected to sensors of the operating speed levels of the machine, for tripping the cam connections so that the sealing action of the sealing contrivances is put into or out of operation to suit the operating speed levels of the machine detected by the speed sensors. According to the invention reciprocating cams are provided with differentiated operating time multiple tracks; heat sensitive control means being connected to the sealing contrivances and being able, at the time of the switching in of the sealing contrivances in their respective operative sealing position when the corresponding speed level of the machine has been restored, to operate means that follow up the cams with differentiated operating time multiple tracks so as to operate the sealing contrivances in a differentiated succession to suit the temperature detected in the sealing contrivances by the heat-sensitive control means.

BRIEF DESCRIPTION OF THE DRAWINGS

Further characteristics and advantages will emerge more clearly from the following detailed description of a preferred but not the sole form of embodiment for the device according to the invention. In the accompanying drawings

DESCRIPTION OF THE PREFERRED EMBODIMENT

Figure 1:
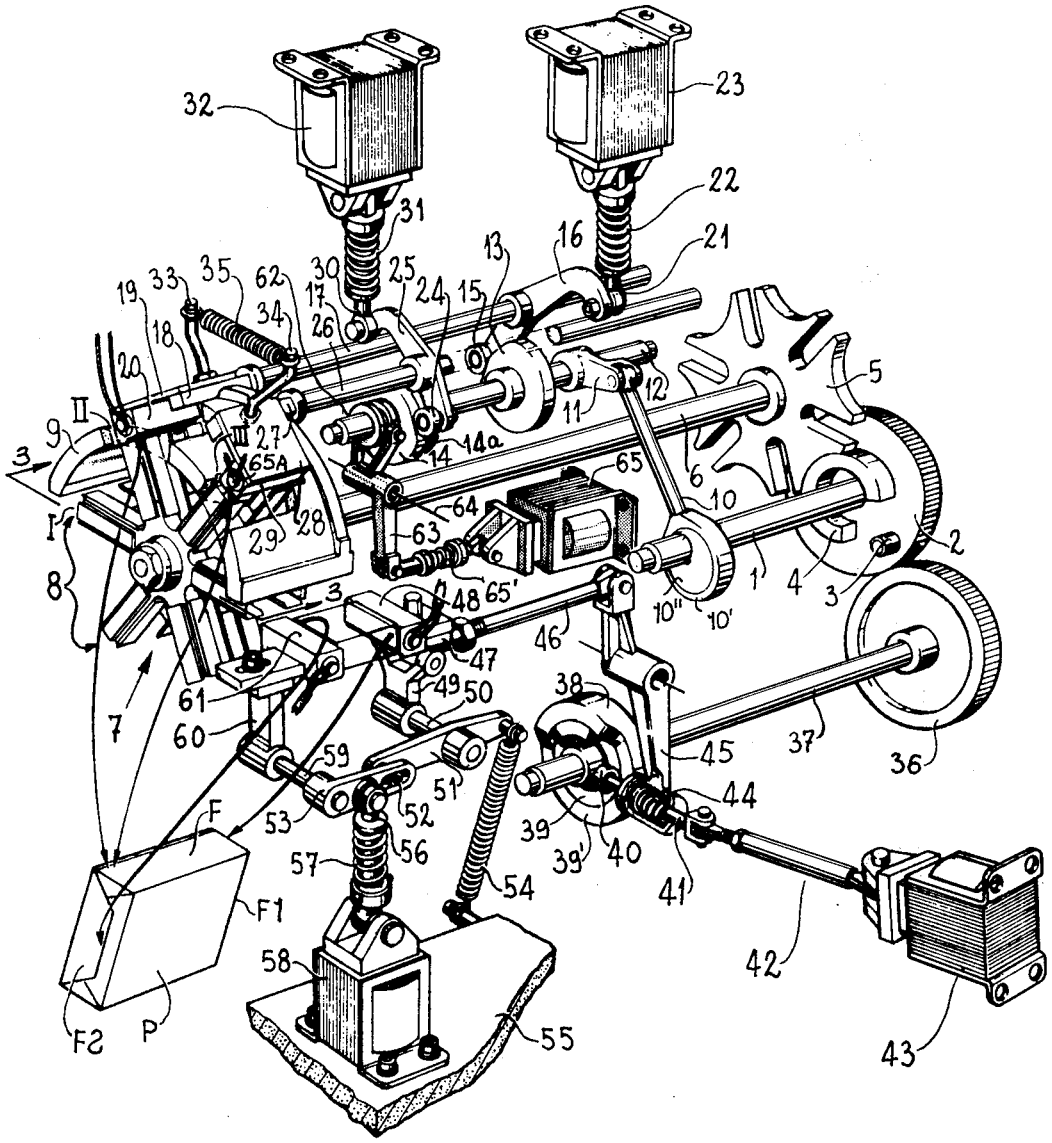
FIG. 1 shows diagrammatically, in a perspective view, a system according to the invention

With particular reference to FIG. 1, a horizontal drive shaft 1 of the entire overwrapping machine and of the present device.

The said shaft 1 has keyed onto it a gearwheel 2 and on one side of this, diametrically opposed to each other, are fixed a pin or idle roller 3 and an arcuate member or centering device 4. These members 3 and 4 bring about intermittent movement of a six compartment Geneva mechanism 5 rigidly mounted on a horizontal shaft 6 to the front end of which a packet-transferring means is secured. This means is shown as comprising a wrapping wheel 7, which accordingly, completes one forward movement or step 60°, clockwise, followed by a halt, each time the shaft 1 makes one counterclockwise turn.

The wrapping wheel 7 has six radial compartments 8. When one of these, at a halt of Geneva mechanism 5 and wheel 7, is at a first station I, a packet P of cigarettes is inserted in the compartment. For this purpose the packet is moved on edge with respect to the axis of wheel 7, along with a sheet of transparent material for the formation of the outer wrap.

The two ends of the sheet of wrapping material that protrude radially from the wheel 7 are then folded onto the external side of the packet by stationary and movable folding members, not shown in full.

A guide 9 delimitates the upper part of the wheel 7 for approximately 180°.

An end of a connecting rod 10 is shown as secured to a sleeve 10' which surrounds an eccentric disk 10'' secured to shaft 1. The other end of rod 10 is pivotally fastened to one extremity of a lever 11. The other extremity of the lever is secured to a shaft 12 parallel with the shaft 1, for oscillating that shaft around its axis.

From right to left, looking at FIG. 1, the shaft 12 has keyed onto it first and second cams 13 and 14.

An first idle roller 15 turns on a horizontal pin, carried at one end of a two armed lever 16 pivoted to a shaft 17 parallel with the shaft 12, and runs along the profile of the cam 13. A first horizontal bar 18 fixed to the lefthand end of the shaft 17 extends transversely above the guide 9 to support a rectangular plate 19. This plate 19 supports, above an aperture in the guide 9, constituting station II for the compartments of wheel 7, positioned at 60° from the station I, a first electrically heated sealing member 20.

The extremity of the second arm of the two armed lever 16 is connected to the lower end of a vertical rod 21 integral with the keeper of an electromagnet 23 and is biased downwardly by a spring 22.

In exactly the same way as described in respect of the cam 13, a second idle roller 24 turns on a horizontal pin, carried at one end of a two armed lever 25 pivoted to a shaft 26 parallel with the shaft 12, and runs along the profile of the cam 14. A second horizontal bar 27 is fixed to the lefthand end of the shaft 26, and extends transversely above the guide 9 to support a rectangular plate 28. This plate 28 supports, above an aperture in the guide 9, constituting station III for the wheel 7, positioned at 120° from the station I, a second electrically heated sealing member 29; and the extremity of the second arm of the two armed lever 25 is connected to the lower end of a vertical rod 30 integral with the keeper of an electromagnet 32 and biased downwardly by a spring 31.

Fixed onto the heater supporting plates 19 and 28 are bars 33 and 34, respectively, the upper ends of which are connected to each other through a spring 35 which is under tension and offsets the action of the electromagnets 23 and 32 by cooperating with springs 22, 31 to bias the heated sealing members 20, 29 to tilt about their shafts, away from wheel 7, as shown.

Under normal operating conditions, that is to say, when the overwrapping machine is running at its rated speed, which is its second speed, both the electromagnets 23 and 32 are excited. Consequently, as described, the first and second idle rollers 15 and 24 run along the profiles of the cams 13 and 14, respectively.

The conformation of the cam profiles is such that once in the rotation of each cam, that is, each time the wheel 7 comes to standstill, the sealing members 20 and 29 approach the external sides F of the two packets of cigarettes P, positioned in the vicinity of station II and station III, respectively. They are subsequently caused by spring 35 to move away therefrom once the sealing operation is over.

The sealing of the side F on the transparent thermoplastic wrap thus takes place for each packet, under the described operating conditions, in two separate phases, namely, an initial phase in station II performed by the first sealing member 20 and then a final phase, performed by the second sealing member 29 in station III. The sealing is carried out for sufficiently long a contact time to allow the operation to be carried out perfectly and to be in conformity with the contents of the copending Patent applications Ser. Nos. 589,878-589,879 and 589,895 assigned to the assignee hereof.

Let it now be assumed that the overwrapping machine is operating at a value below its rated or first speed which, as is known, can happen when the machine is being started up or also in cases of emergency.

Under these particular conditions the drive shaft 1 also rotates at a speed below that previously considered. As a result the total contact time between the surfaces of the sealing members 20, 29 and the individual sheets of transparent material on packets P is lengthened to the extent that it gives rise, bearing in mind the restricted temperature limits permissible for the materials under consideration, to the various annoyances described above and in the opening paragraphs of the cited Patent Applications.

For this reason the electrical control circuit for the overwrapping machine (which will be described in relation to FIG. 2) is set in such a way as to cut off one of the two sealing members through the automatic drop out of the respective electromagnet 23 or 32, when slow running is experienced, while the cam for the second sealing member is provided with a profile with which it is possible to generate, under the new conditions, a contact time which is sufficiently long to guarantee the sealing operation being perfectly successful.

The de-energizing of the electromagnet 32 is, for example, followed by the sealing member 29 being immediately lifted away from the area in which it works and by its rotating around the shaft 26 under the joint action of the springs 31 and 35.

In the event of the overwrapping machine coming to a stop for any reason, provision is made so as to prevent the packets contained in the compartments at a standstill in stations II and III from being subjected to an excessively long period of contact with the sealing members concerned. For this purpose the two electromagnets 23 and 32 drop out automatically and thus the sealing members 20, 29 are lifted away from the areas in which they work.

As mentioned above, the taking out of the sealing operation of the sealing member 29 causes it to overheat due to thermal inertia. Thus when, following a corresponding variation in the speed level of the machine, it is again put back into the sealing operation, it causes the thermoplastic wrapping material to be scorched or even burnt.

In order to prevent this from happening, in a preferred form of embodiment for the present invention, cam 14 has a second cam track 14*a*, the operating time of which, as will be seen better in due course, differs from that of the cam 14.

The cam with different operating time tracks 14 and 14*a* is mounted so that it slides but does not rotate on the oscillating shaft 12, as a result of a spline broaching 62. The hub of the cam 14–14*a* is, furthermore, so shaped that it engages in a known fashion with one of the arms of a two armed lever 63 that oscillates around a shaft 64 perpendicular to the cam shaft 12. The other arm of lever 63 is articulated onto the keeper of an electromagnet 65, which keeper is elastically restrained by a spring 65′.

After the described sealing operation is over, the areas corresponding to the two ends on each packet still have to be sealed in order to complete the sealing of the outer wrap. This is done after the packets of cigarettes have been transferred from the wheel 7 to an exiting channel, by means that form the subject of the cited patent application Ser. No. 589,878, brief details of which are given in the following paragraphs, preceding the description of the electric circuit shown in FIG. 2.

Through the gearwheel 2, the drive shaft 1 rotates a gear 36 keyed onto a shaft 37 parallel with the shaft 1, the lefthand far end of the former being integral with a cam 38, on the front side of which there are two tracks, 39 and 39′, respectively, which are concentric with respect to the shaft 37. If the overwrapping machine is running at its rated speed, the inner track 39 has running over it an idle roller 40 mounted on a horizontal shaft 41 connected, via a rod 42, to the keeper of an electromagnet 43 which is normally in a state of excitation. The shaft 41 passes the movement derived via the roller 40 from the cam 38 onto a two armed lever 45. At a point corresponding to where it has a spring 44 enclosed around it, the shaft 41 passes into a hollow end of one of the arms of the said two armed lever 45, in such a way that it is able to slide axially from left to right with respect to the hollow end. This takes place, in the case of the electromagnet 43 being de-energized, by the action of the spring 44, the two ends of which are connected to the shaft 41 and to the extremity of the two armed lever 45, respectively, and which, in the considered case of the machine operating at its rated speed, is stretched. The second arm of the two armed lever 45 is connected, through a rod 46, to a block 47 for supporting an electrically heated sealing member 48 for the rear end F1 of packet P. The block 47 is also connected, through a lever 49, to a horizontal shaft 50 parallel with an exiting channel, of wheel 7. Shaft 50 serves as a pivot for a two armed lever 51 with which it is integral. The exiting channel is diametrically opposite station I. The front arm (on the left looking at FIG. 1) on the two armed lever 51 is provided with a pin 52 which is horizontal and is inserted in a slot in a lever 53. The rear arm is connected, via a spring 54, to a plate 55 integral with the bedplate of the overwrapping machine. The lever 53 is pivoted, at an intermediate point, to the upper extremity of a vertical shaft 56 connected to the keeper of an electromagnet 58 mounted on the bed plate 55 and restrained by a spring 57 when it is excited. The second extremity of the lever 53 is integral with a shaft 59 parallel with the shaft 50 and integral with a block 60 for supporting an electrically heated sealing member 61 for the front end F2 of the packet P.

Through the described mechanical connections, the cam 38 causes the sealing members 48 and 61 to simultaneously approach, in a direction crosswise to the exiting channel and during each halt of the wheel 7, the ends F1 and F2, respectively, on each packet P of cigarettes, and then to move away therefrom at the time the packet is moving forward through the exiting channel.

When the machine is being started up, or for some emergency reason is running at a speed below its rating, the electromagnet 43 is, as more fully described in the aforementioned U.S. patent application Ser. No. 589,878, automatically de-energized. As a consequence of the pull exerted on the shaft 41 by the spring 44, the idle roller 40 is carried onto the outer track 39′ of the cam 38. On this outer track 39′, a section for moving the sealing members 48 and 61 away from their respective operating areas extends for a greater number of degrees than is the case with the inner track 39.

Finally, in a case of a stoppage on the part of the overwrapping machine, to prevent damage occurring to the packet positioned on the exiting channel at a point where the sealing of its ends takes place, the electromagnet 58 is automatically de-energized to allow, under the pull of the spring 54 and the push of the spring 57, the two sealing members 48 and 61 to be simultaneously moved away from the ends F1 and F2, respectively.

Figure 2:
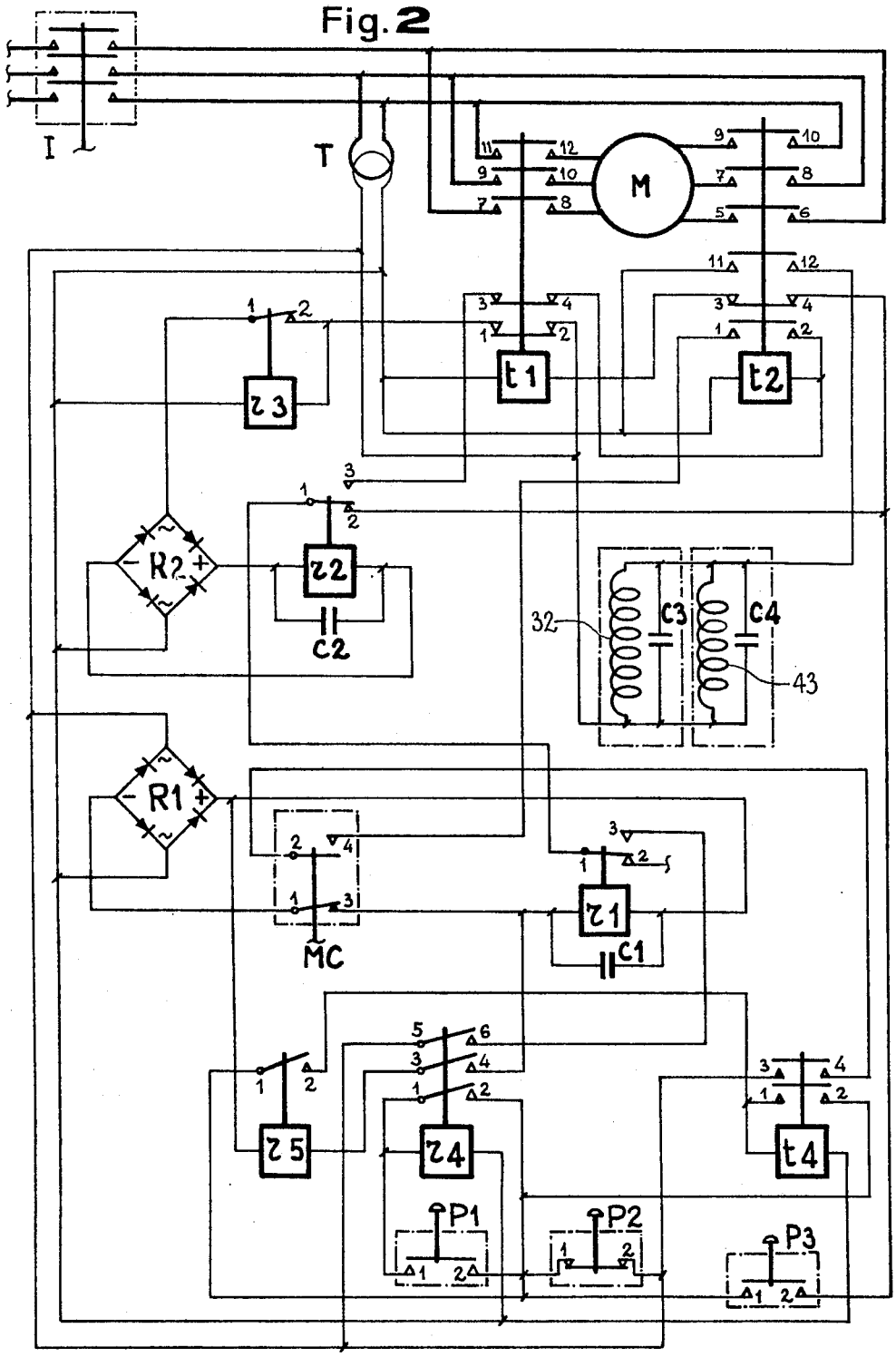
FIG. 2 shows diagrammatically the electrical control circuit for the system of FIG. 1.

Reference should now be made to FIG. 2 in which the electrical circuit is shown for the motor M of drive shaft 1 and for the principal electromagnets. A microswitch MC is provided which normally has its contacts 1–3 closed and its contacts 2–4 open. A relay *r*1 for a first speed timer is energized with direct current from a rectifier R1 through the closed contacts 1–3 of the microswitch MC.

A relay *r*3 is energized through a normally closed pair of contacts 1–2 of a contactor *t*1. Through a pair of contacts 1–2 of relay *r*3 and the pair of contacts 1–2 of contactor *t*1 current is sent to a current rectifier R2 which excites a relay *r*2 for a second speed timer.

Under these conditions, the motor M for operating the overwrapping machine is at a standstill.

When a manual pushbutton P1 is pressed, a relay *r*4 is excited through a manual pushbutton stop switch P2 and thereby stays self-excited through its pair of contacts 1–2 and the pushbutton stop switch P2. The excitation of the relay *r*4 causes, through its pair of contacts 3–4 and the contacts 1–3 of the microswitch MC, a relay *r*5 to be energized and to be supplied with direct current from the current rectifier R1.

The excitation of the relay *r*5 brings about, through its contacts 1–2 and the stop switch P2, the energizing of a contactor *t*4 which stays self-excited through its pair of contacts 1–2 and the stop switch P2.

When the packets to be fed to the overwrapping machine reach the microswitch MC they change over the position of its contacts from 1–3 closed and from 2–4 open. At a time preset by a capacitor *c*1, this changeover causes the relay *r*1 to drop out and thus, through the pair of contacts 5–6 of the relay *r*4, self-excited as seen earlier on, the pair of contacts 1–3 of the relay *r*1 itself, the pair of contacts 1–2 of the energized relay *r*2 and the pairs of contacts 3–4 of the contactor *t*2, to energize the contactor *t*1 and to set the motor M going at its first speed, through its pairs of contacts 7–8, 9–10 and 11–12. With the excitation of the contactor *t*1 its contacts 1–2 open and thus with the relay *r*3 dropping out, the supply to the rectifier R2 ceases and, consequentially, at the time preset by a capacitor *c*2, the relay *r*2 is de-energized.

In this way the changeover occurs of the contacts of the relay *r*2 from the position 1–2 to the position 1–3 which results in the contactor *t*1 dropping out and the contactor *t*2 being energized through the pairs of contacts 5–6 of the relay *r*4, 1–3 of the relay *r*1, 1–3 of the relay *r*2 and 3–4 of the contactor *t*1 itself. The excitation of the contactor *t*2 brings about the closing of its contacts 5–6, 7–8 and 9–10 and a change in the speed of the motor M from the first speed to the second speed, as well as the closing of the contacts 11–12, at the time preset by the capacitors *c*3 and *c*4, respectively, of the electromagnets 32 and 43, respectively, for the insertion in the operating cycle of the sealing members 29, and 48 and 61.

As can be seen from the foregoing description of the operation of the overwrapping machine, when the machine is running at the speed called the "first speed", the electromagnets 32 and 43 are de-energized. Both of them are automatically excited when there is a change over to what is known as the "second" or "rated speed". In practice this occurs with the switching into and out of the sealing cycle of the sealing member 29, insofar as electromagnet 32 is concerned, and with the engagement of the selector means 40–41 with track 39' or track 39 of the cam 38, insofar as electromagnet 43 is concerned.

Figure 3:
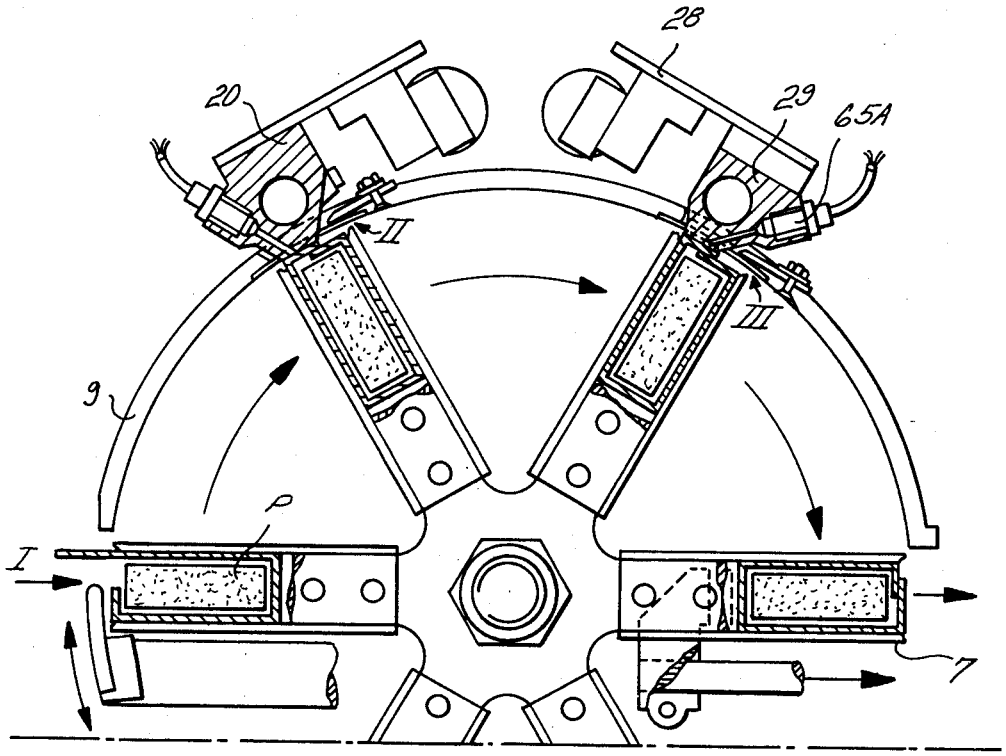
FIG. 3 is a fragmentary sectional view taken along lines 3—3 in FIG. 1.

When the machine operates with the sealing member 29 cut off from its operative position, that is to say, when it is running at its first speed, as mentioned previously the sealing member 29 overheats due to thermal inertia. To counteract this heat-sensitive means 65A are connected to the sealing member 29, for example (FIG. 3) in accordance with the cited patent application Ser. No. 589,895 of the Assignees hereof. Thereby, the electromagnet 65 is energized and this, through the two armed lever 63 determines, against the elastic restraining action of spring 65', the displacement under the cam follower 24 of the track 14*a*. The preset operating time of the track 14*a* differs from that of the track 14, to offset the raised temperature detected in the sealing member 29 by the heat-sensitive means, so that the switching in of the sealing member 29, through the excitation of the electromagnet 32 and the resulting change from the first speed to the rated speed occurs (a) with operating times which take overheating into consideration and (b), once its temperature has stabilized itself at the customary operating temperature, with automatic de-energizing, through the heat-sensitive means, of the electromagnet 65 and with consequent return, through the elastic restraining action of spring 65', of the track 14 under the cam follower 24.

What is claimed is:

1. A device for sealing thermoplastic overwraps on cigarette packets, comprising;

packet-transferring means having means for moving it at a plurality of speed levels subject to periodic halts, the transferring means being receptive during each halt of a cigarette packet and of thermoplastic overwrap material for it at a first station, and having successive halting stations for successively heat-sealing the thermoplastic overwrap material on a single portion of the packet;

successive sealing contrivances, one disposed at each successive station in a position adjacent the transferring means, each contrivance being mounted for movements back and forth into and from contact with said single portion of the packet;

support means for each sealing contrivance, supporting it in said position for effecting said movements at a speed dependent on said speed levels;

control cam means having a follower linkage including a cam follower, for performing the movements of each sealing contrivance, and having a cam which has a plurality of cam surfaces to enable performing the movements of one of the sealing contrivances with different ratios of movements into contact and movements away from contact with the packet depending on different positions of the respective cam follower relative to said cam surfaces;

a heat sensor in said one sealing contrivance; and heat compensator means for controlling the position of the cam follower relative to said cam surfaces in response to a level of heat sensed by the heat sensor to control the ratios of the movements of said one heating contrivance so as to compensate for the level of heat sensed by the heat sensor.

2. A device according to claim 1 in which the single cam has the plurality of cam surfaces disposed as cam rings, said single cam and the respective cam follower being slidable relative to one another to engage the follower selectively with any one and another of said rings, and a link for effecting relative sliding of the cam and cam follower.

3. A device according to claim 2 in which the heat compensator means comprises an electromagnet for moving the link to effect the relative sliding of the cam and follower, and a spring for resiliently counter-acting the electromagnet.

* * * * *